United States Patent [19]

Viscosi

[11] 4,012,100

[45] Mar. 15, 1977

[54] ELECTRICAL JUNCTION CONNECTOR MODULE

[76] Inventor: Armando J. Viscosi, 1360 E. 95th St., Brooklyn, N.Y. 11236

[22] Filed: Nov. 20, 1975

[21] Appl. No.: 633,626

[52] U.S. Cl. ..... 339/95 D; 339/198 H

[51] Int. Cl.[2] ..... H01R 9/12

[58] Field of Search ..... 339/95 D, 198 G, 198 H

[56] References Cited

UNITED STATES PATENTS

| | | | |
|---|---|---|---|
| 2,925,577 | 2/1960 | Cetran | 339/198 H |
| 3,393,397 | 7/1968 | Manichl | 339/95 D |
| 3,569,911 | 3/1971 | Bogdanowicz | 339/95 D |
| 3,585,570 | 6/1971 | Jans | 339/95 D |
| 3,701,087 | 10/1972 | Bernard | 339/198 G |

*Primary Examiner*—Roy Lake
*Assistant Examiner*—Howard N. Goldberg
*Attorney, Agent, or Firm*—Jack D. Slobod

[57] ABSTRACT

An electrical connector module includes male and female electrical connectors and fasteners formed on opposite side surfaces of a rectangular block of dielectric which are dimensioned for mutual engagement to enable plural modules to be electrically stacked and interconnected in side-by-side relationship. Each module has a bore which receives an electrical wire and resilient metal strips extending in the block from the connectors to the bore project into the bore for bearing against the wire.

5 Claims, 3 Drawing Figures

ELECTRICAL JUNCTION CONNECTOR MODULE

FIELD OF THE INVENTION

The present invention relates generally to electrical connectors for joining a plurality of wires at a junction. In its particular aspects, the present invention relates to the provision of electrically and mechanically interconnectable modules formed in dielectric blocks each for receiving an electrical wire.

BACKGROUND OF THE INVENTION

In the usual junction connector for electrical wires plural spaced apart openings are provided in a single metal block. Each wire is clamped in each opening by a metal screw projecting into the opening which has to be tightened. Since the metal screw has to be engaged by an appropriate tool, it is dangerous to work on such a junction when the wires are electrically energized. Further, since the openings in such a junction connector are generally relatively large for accommodating a range of wire sizes it is often necessary to double the wiring over to more nearly fill the opening. This aspect results in time consuming labor when working on such a junction.

OBJECTS OF THE INVENTION

It is an object of the present invention to provide an individual module for engaging each electrical wire which modules can be snapped together to form a junction connector so that each module may be configured for engaging a different sized wire.

It is a further object of the present invention to provide interconnectable modules each for engaging an electrical wire which modules may be safely handled when the wiring is electrically energized. It is yet another object of the present invention to provide an electrical connector for engaging an electrical wire frictionally by resilient means so that there are no clamping screws to tighten.

SUMMARY OF THE INVENTION

Briefly, the aforementioned and other objects of the present invention are satisfied by providing an electrical connector module formed in a block of electrically insulating material having first and second opposed side surfaces on which are respectively formed first and second electrical connectors dimensioned for mutual engagement to enable the modules to be stacked and interconnected in side by side relationship. A first bore is provided in the block which is sized in relation to the diameter of an electrical wire being used in order to receive the wire.

Electrical conductor means extend within the block from the first and second connectors to the bore. The conductor means comprises resilient metal strips projecting into the bore for making contact with and frictionally engaging the wire.

One feature of the present invention is the provision of a second bore in the block extending from an outside surface to one of the metal strips to enable a tool to be inserted in the second bore for deflecting the metal strip to release the wire.

Another feature of the present invention is the provision of fasteners on the first and second surfaces in addition to the electrical connectors to enable stacking of the modules. On each surface a pair of different fasteners is used. One fastener type engages as a pair of adjacent modules are relatively pivotted while the other is a snap fastener.

Still another feature of the present invention is the provision of the first and second connectors as third and fourth bores one of which threadably carries a projecting pin. The bore carrying the pin is also adapted to receive a wire when the pin is removed and inserted in a fifth threaded bore intersecting the previous bore to serve as a clamping screw.

Other objects, features and advantages of the present invention will become apparent upon perusal of the following detailed description of the preferred embodiment thereof when taken in conjunction with the appended drawing wherein.

DETAILED DESCRIPTION

Figure 1:
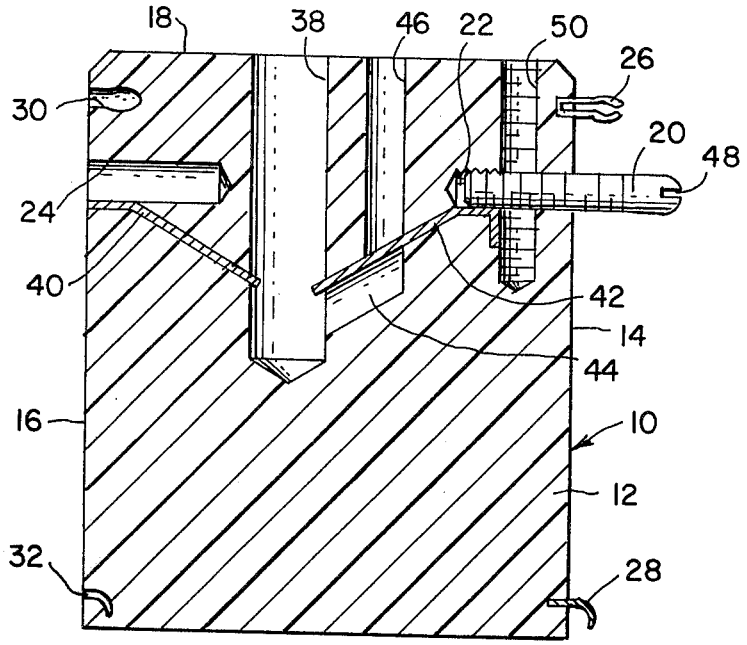
FIG. 1 is a side cross-sectional view of the connector module of the present invention.
Figure 2:
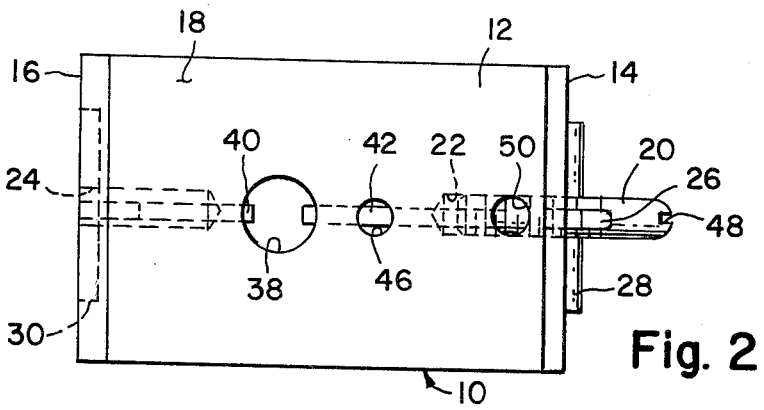
FIG. 2 is a top view of FIG. 1.
Figure 3:
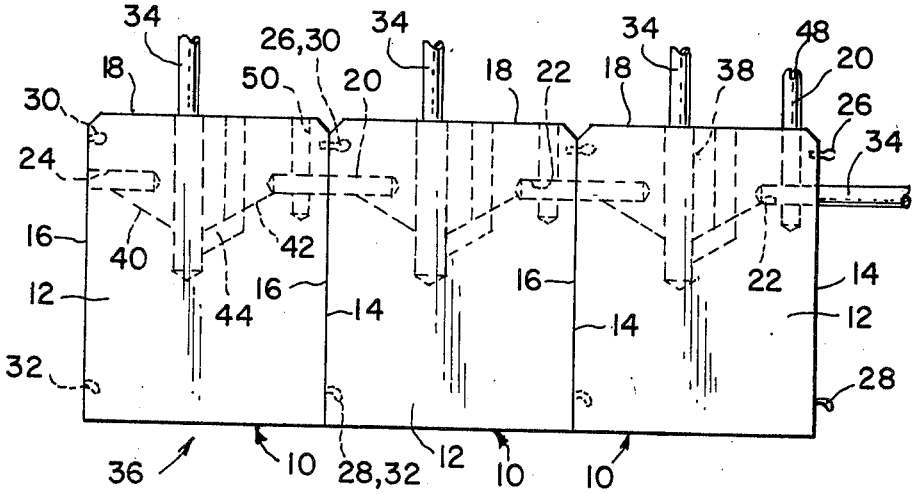
FIG. 3 is a side view of a plurality of the modules of FIGS. 1 and 2 interconnected as used.

Referring to FIGS. 1 through 3 of the drawing, the connector module of the present invention is generally indicated by the reference numeral 10. Module 10 is generally a rectangular block 12 of dielectric or insulating material having opposed side surface 14 and 16 and a top surface 18 extending between the side surfaces.

From side surfaces 14 there is provided projecting an externally threaded metal pin 20 threadably engaged in a bore 22 in block 12 directed perpendicular to surface 14. As will be understood as the discussion proceeds pin 20 functions as a male electrical connector dimensioned to be received in a female electrical connector which includes a bore 24 in block 12 directed normal to surface 16 and in line with bore 22.

Further, a male snap fastener member 26 projects for surface 14 above pin 20 and a blade 28 elongated along surface 14 below pin 20 projects outwardly and downwardly from the surface in the nature of an arcuate hook. On the surface 16 a female socket 30 is provided opposite fastener 26 dimensioned for the fastener 26 to be snapped therein and an arcuate elongated groove 32 is provided opposite blade 28 dimensioned for receiving the blade.

As shown in FIG. 3 when a pair of modules 10 are aligned with their respective sides 14 and 16 adjacent they are maintained together by the mutually engaged fasteners 26, 30 and 28, 32 and are electrically interconnected by the pin 20 in the bore 24. A pair of the modules 10 are engaged by turning the side 14 of one of the modules at approximately a 90° angle with respect to the side 16 of the other module so that the free end of blade 28 may be started in groove 32. The two modules are then relatively rotated to a side by side relationship pivoting about the blade 28 and groove 30 combination until the pin 20 slips into bore 24 and the male fastener 26 into socket 30.

It will be appreciated that since the block 12 is dielectric, the modules 10 may be safely handled even if associated with electrically energized wires 34 when a plurality of them are joined together as indicated to form the junction connector 36 illustrated in FIG. 3.

A bore 38 is provided in block 12 normal to top surface 18 and having an opening on the surface for receiving the wire 34. It is envisioned that modules 10 may be made with bores 38 of different diameters in relation to the wire size to be used therein and that modules 10 for different sized wires may be joined together in any desired grouping to form the junction connector 36. Resilient metal strips 40 and 42 respectively run along the sides of bores 22 and 24 and extend within block 12 to project radially inwardly and downwardly into bore 38 from opposite sides for electrically engaging wire 34 and electrically interconnecting the wire to the bores 22 and 24. The bore 38 may be sized for receiving a solid core wire, whose leading portion would be stripped of insulation and its bare copper would then engage strips 40 and 42.

Under strip 42 adjacent bore 38, there is provided a cavity 44 enabling the free end of the strip to be deflected downward and out of the bore. Further, a bore 46 is provided in block 12 running parallel to bore 38 from surface 18 to the blade 42 and cavity 44. To release the wire 34 frictionally retained in bore 38 by the strips 40 and 42, a tool such as a plastic rod (not shown) may be inserted in bore 46 to bear on an exposed part of strip 42 deflecting its free end downward into cavity 44 so that the wire may be pulled out.

In the right-most module 10 of the junction connector 36 the pin 20 may be unthreaded and removed from bore 22 so that there will be no projecting uninsulated parts in the completed junction. To aid in unthreading, the end of pin 20 is provided with a slot 48. To enable the bore 22 also to accept a wire 34, a threaded bore 50 may be provided extending from surface 18 and intersecting bore 22. The bore 50 has a thread accepting the pin 20 to enable its use as a clamping screw for the wire 34 in bore 22. Bore 22 may also be used for smaller gauge stranded wires.

While the preferred embodiment of the present invention has been described in specific detail, it should be noted that numerous modifications, additions and omissions in the details thereof are possible within the intended spirit and scope of the invention claimed herein.

What is claimed is:

1. An electrical junction connector for electrically interconnecting the ends of a plurality of wires, said connector comprising: a plurality of blocks of dielectric material; said blocks being adapted to be stacked in side by side adjacent relationship; each block having:

a. oppositely facing first and second surfaces for abutting adjacent ones of said blocks;

b. an electrically conductive socket means formed in said first surface;

c. an electrically conductive plug means extending from said second surface for engaging the socket means of an adjacent one of said blocks;

d. a third surface extending between said first and second surfaces;

e. a first bore opening on said third surface for receiving the end of one of said wires; and f. and electrical conductor means extending within said block from said socket means and from said plug means to said first bore.

2. The connector of claim 1 wherein said electrical conductor means includes a spring means projecting into said first bore for bearing on said wire and further comprising a second bore in said block extending from said third surface to said spring means for providing access to the interior of said block for deflecting said spring means away from said wire.

3. The connector of claim 1 further comprising first and second fastener means located respectively on said first and second surfaces; said first fastener means being engageable with the second fastener means of an adjacent one of said blocks.

4. The connector of claim 3 wherein said first fastener means comprises third and fourth fasteners spaced apart on said first surface and wherein said second fastener means comprises fifth and sixth fasteners spaced apart on said second surface; said third fastener being configured for pivotal engagement with the fifth fastener of an adjacent one of said blocks and the fourth fastener being configured for snap engagement with the sixth fastener of said adjacent one of said blocks.

5. The connector of claim 1 wherein said plug means comprises a second internally threaded bore in said block opening on said second surface and a metal pin threadably engaged in said second bore and projecting from said second surface.

* * * * *